US005259782A

United States Patent [19]

Giffin

[11] Patent Number: 5,259,782

[45] Date of Patent: Nov. 9, 1993

[54] ELECTRICAL CONNECTOR JACKET

[76] Inventor: Kevin H. Giffin, 2951 Swansboro Rd., Placerville, Calif. 95667

[21] Appl. No.: 905,006

[22] Filed: Jun. 26, 1992

[51] Int. Cl.[5] ..... H01R 13/62

[52] U.S. Cl. ..... 439/367; 439/314; 439/369

[58] Field of Search ..... 439/367, 368, 369, 370, 439/314-318, 365

[56] References Cited

U.S. PATENT DOCUMENTS

| | | | |
|---|---|---|---|
| 3,030,601 | 4/1962 | Krebs | 439/367 |
| 3,192,499 | 6/1965 | West | 339/91 |
| 3,316,523 | 4/1967 | Trangmar | 439/369 |
| 3,344,393 | 9/1967 | Hendee | 439/369 |
| 3,484,736 | 12/1969 | Wyse | 339/61 |
| 3,721,939 | 3/1973 | Paugh | 339/14 R |
| 4,146,288 | 3/1979 | Ramsay et al. | 439/316 |
| 4,643,505 | 2/1987 | House et al. | 339/75 P |
| 4,784,612 | 11/1988 | Ryan | 439/367 |
| 4,940,424 | 7/1990 | Odbert | 439/314 |
| 4,998,891 | 3/1991 | Bresko | 439/369 |
| 5,069,634 | 12/1991 | Chiarolanzio | 439/353 |
| 5,118,303 | 6/1992 | LeBaron et al. | 439/316 |

FOREIGN PATENT DOCUMENTS

| | | | |
|---|---|---|---|
| 0641105 | 6/1962 | Italy | 439/316 |

*Primary Examiner*—Larry I. Schwartz
*Assistant Examiner*—Hien D. Vu
*Attorney, Agent, or Firm*—James M. Ritchey

[57] ABSTRACT

Described is an electrical connector jacket for protecting and preserving an electrically functioning coupling between a cord attached plug and a cord attached receptacle.

13 Claims, 5 Drawing Sheets

ELECTRICAL CONNECTOR JACKET

BACKGROUND OF THE INVENTION

1. Field of the Invention

The subject invention relates to means for maintaining or preserving a functioning electrical connection between electrical coupling elements. Particularly, disclosed is a jacket or shield for protecting an extension cord to tool cord electrical coupling from becoming uncoupled or lodged on or in a rough area during movement of the coupling.

2. Description of the Background Art

In the course of construction or building projects that involve the use of electrical equipment, an extension power cord is often coupled to various electrical tools such as saws, drills, sanders, and the like. For reliability and mobility, the coupling between the power cord and the tool cord should be a firm connection, not easily separated by pulling or dragging, and configured to have a surface not easily caught, during movement, by rough areas in the environment. None of the prior art devices provides suitable reliability and mobility. The subject invention overcomes the limitations of the prior art by having a streamlined outer surface and a reliable means for holding the coupling elements together.

Specifically, U.S. Pat. No. 3,192,499 presents a safety fastening means for securing two electrical wires to one another. Interlocking elements reversibly mate.

U.S. Pat. No. 3,484,736 discloses a quick disconnector for use with electrical cords. A cable assembly has an improved plastic male or female connector on the other portion thereof adapted to easily engage and disengage the standard threads of the mating connector without turning by reason of the resilience of the plastic material.

Related in U.S. Pat. No. 3,721,939 is an electrical connector. Comprising the device are several mating elements for each of two, plug and receptacle, connectors.

U.S. Pat. No. 4,643,505 make known an extension cord connector housing. A hinged pair of members reversibly snap close around mated couplers from two cords. Slotted retaining washers fit within grooves in each of the pair of hinged members and function to hold the couplers together within the closed housing.

An elongated electrical plug holder is delineated in U.S. Pat. No. 4,784,612. Each one of oppositely threaded male and female holder halves has a cord receiving slot. Upon fitting within each holder half a plug or receptacle, the two holder halves are screwed shut. Each end of the holder has a hemispherical outer surface.

U.S. Pat. No. 4,940,424 recites an electrical plug accessory for reversibly covering male and female connectors. Each cover for the male and female connectors is comprised of two halves that fit together. The male connector has two opposing detents that slide within receiving grooves in the female connector. For a tighter coupling of the male and female connectors, a plurality of receiving grooves exist in the female connector.

Supplied in U.S. Pat. No. 4,998,891 is a holder for maintaining electrical connections. Three prongs are found on a male connector cover half and a plurality of three matched receiving slot sets are formed in the female connector cover. Each male and female half is formed around a cord having a plug or receptacle. The two halves are secured to one another by inserting the male portion into the female portion and engaging the prongs with the receiving slots.

Lastly, U.S. Pat. No. 5,069,634 communicates a snap lock extension cord and power tool connector. Formed integrally on the end of a plug fitted cord and on the end of a receptacle containing cord are reversible mating means. The receptacle has prongs that fit reversibly into notches in the plug.

SUMMARY OF THE INVENTION

An object of the present invention is to provide an electrical connection protective jacket that helps to maintain an electrically functioning connection between a plug and a receptacle.

Another object of the present invention is to produce an electrical connection or coupling protective jacket that has an outer surface that easily slips over rough environmental territories in constructions areas that might catch an unprotected coupling.

A further object of the present invention is to generate a simplified electrical connection jacket that requires a minimum of fabrication steps to create.

Still another object of the present invention is to provide an electrical connector jacket that forms from two housing in which each housing is reversibly associated with a plug and cord or a receptacle and cord.

Disclosed is an electrical connector jacket for preserving an electrically functioning coupling between a plug attached to a first cord and a receptacle attached to a second cord. Comprising the subject invention is a first housing for surrounding and holding the plug. The first housing comprises two like halves that interlock with one another to surround the plug. Included is a second housing for surrounding and holding the receptacle. Like the first housing, the second housing comprises two the halves that interlock with one another to surround the receptacle and the first and the second housings mate with one another to form the jacket.

Each half comprises a curved, elongated wall member having first and second ends. The wall member tapers from a wide first end to a narrow second end with a longitudinal axis extending between the first and the second ends. Means are associated with the wall member for positioning either the plug and the first cord or the receptacle and the second cord within the first or the second housing, respectively. Further, means are associated with the wall member for the interlocking with the other housing half.

Additionally, means are associated with the wall member for the mating between the first and the second housings. The mating means comprises a prong projecting from each wide first end, wherein the prong terminates in a lip. An annular ledge exists at the wide first end. An entrance channel is formed within the ledge for receiving the prong. After the prong enters the channel, the first housing and the second housing are rotated about the longitudinal axis, in opposite directions, and the lip wedges beneath the annular ledge to mate reversible the two housing to form the jacket.

The positioning means often comprises a plurality of receiving grooves formed on the wall member inner surface, proximate the second narrow end. Included is a slotted positioning washer sized to fit within the receiving grooves and around the first or the second cord. The washer abuts the plug or the receptacle, within the first or the second housing, respectively, wherein the slotted positioning washer aligns the plug or the receptacle for forming the electrically functioning coupling by preventing the coupling from disengaging within the jacket. Optionally, the positioning means comprises a slotted spacer selected to fit around the first or the second cord. The spacer abuts the plug or the receptacle, within the first or the second housing, respectively, wherein the slotted spacer aligns the plug or the receptacle for forming the electrically functioning coupling by preventing the coupling from disengaging within the jacket.

Other objects, advantages, and novel features of the present invention will become apparent from the detailed description that follows, when considered in conjunction with the associated drawings.

DESCRIPTION OF THE PREFERRED EMBODIMENT

Referring now to FIGS. 1–9, there are shown two preferred embodiments of an electrical connector jacket 1. Comprising the jacket 1 are first and second housings that mate, usually reversibly, with one another to form the intact jacket 1. Each housing is comprised of two identical housing halves that are interlocked, usually reversibly, with one another. As discussed thoroughly below, depending upon which type of plug or receptacle positioning means is incorporated into the housing half, the reference number for the figures will be either **5*a* (see FIGS. 1–5) or 5*b* (see FIGS. 1 and 6–9). Except for the positioning means, the housing halves 5*a* and 5*b* are identical. Therefore, the jacket 1 has a high degree of symmetry. Since only one housing half needs to be formed (only one type of housing half 5*a* or 5*b*** is required for either of the two preferred positioning means), this configuration is extremely convenient for fabricating the subject device. For injection molding, only one mold (for each positioning means) is employed to form the majority of the jacket structure.

A plug P and receptacle R fit within the jacket 1 to establish the functioning electrical coupling. The cords C1 (affixed to the plug P) and C2 (affixed to the receptacle R) extend through the ends of the jacket 1 and to the power tool and power source. The outside shape of the subject device jacket 1 is shaped to prevent getting caught on rough environmental projections when the cords C1 and C2 are pulled over the ground or through construction areas. The narrow ends of the jacket 1 taper away from the wider center to produce a streamlined form that easily glides over and past regions that would normally stop an unprotected electrical coupling and often separate the connection.

Figure 1:
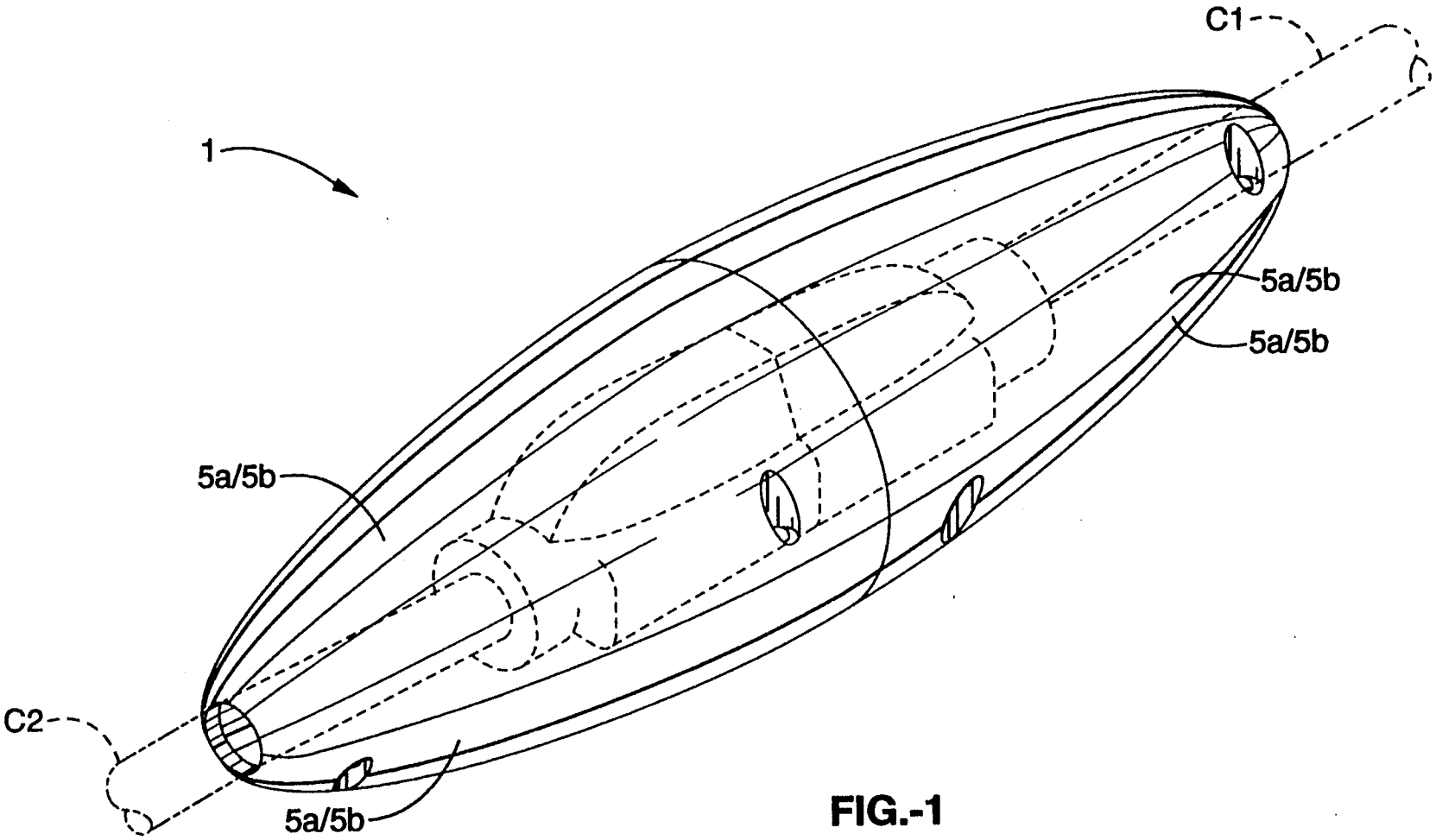
FIG. 1 is a perspective view of the subject invention.
Figure 2:
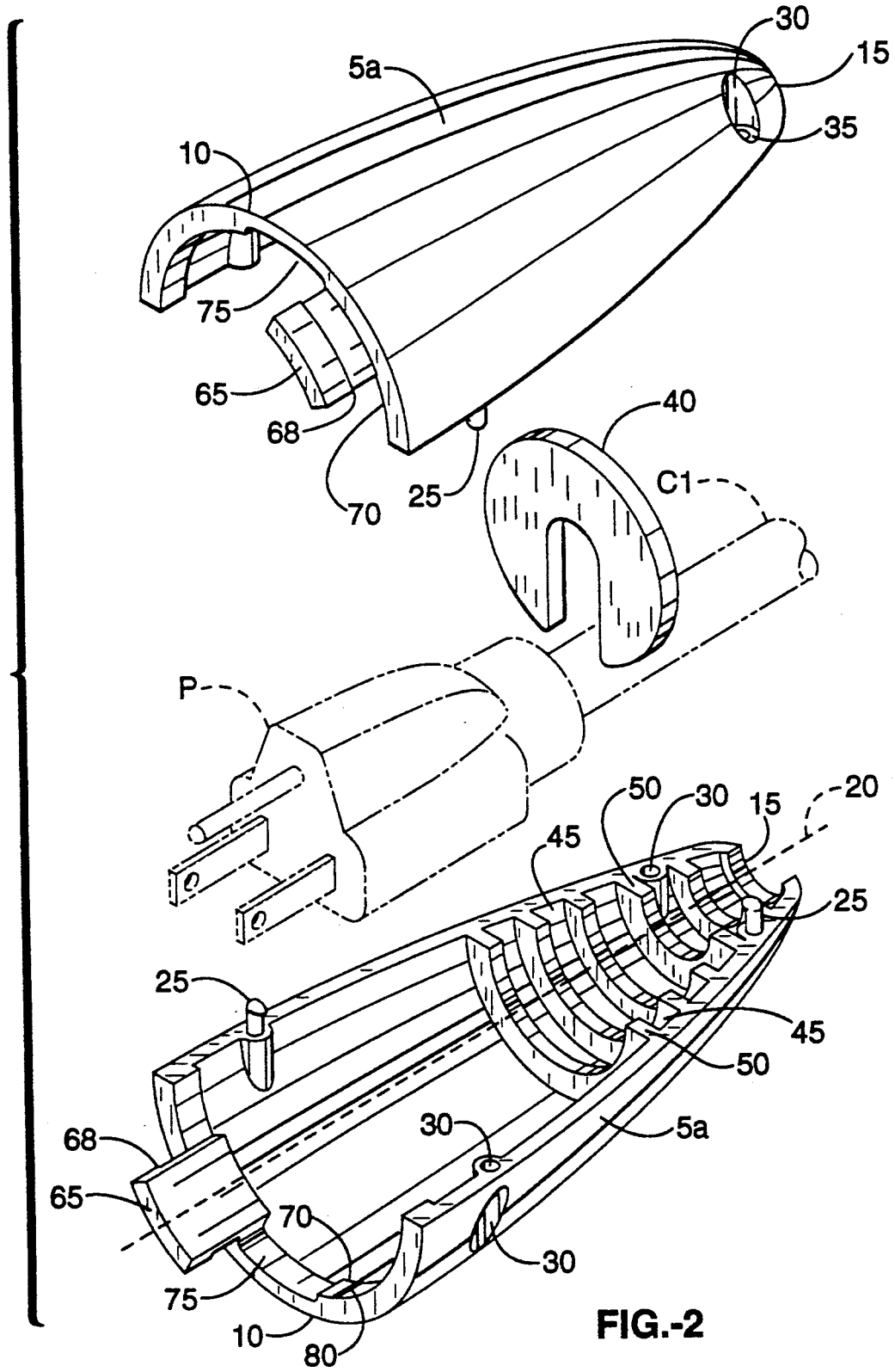
FIG. 2 is an exploded view of one half of the subject invention showing a first housing that will surround and hold a plug in which a slotted positioning washer is utilized to correctly position the plug within the first housing.

FIG. 2 illustrates a preferred form of the subject invention. Even though a plug P and associated cord C1 is shown in FIG. 2 (and FIG. 5) as fitting within the housing, a receptacle R and associated cord C2 is just as acceptable and the choice of the plug P is only for illustrative purposes (note: the same reversible option is true for FIGS. 6 and 9). Each housing half **5*a* has a curved, elongated wall member that has a first wide end 10 that fits around the connector plug P or receptacle R and a second narrow end 15 that fits around the cord C1 of C2. For orientation purposes, a longitudinal axis 20 extends between the first 10 and second 15** ends.

Means are associated with each housing half **5*a* and 5*b* for interlocking one half 5*a* or 5*b* with another similar half 5*a* or 5*b*, respectively, to form a complete housing. Usually, the interlocking process is reversible. Equivalent interlocking means are considered to be within the realm of this disclosure, however, a preferred means is illustrated in the figures as being a barbed pin 25 and a receiving aperture 30. Two diagonally opposing pins 25 are formed on an edge of each housing half 5*a* and 5*b* as are two diagonally opposing apertures 30. Other positions and numbers of pins 25 and apertures 30 are acceptable. After aligning one housing half 5*a* or 5*b* with another housing half 5*a* or 5*b* so that the pins 25 insert into the apertures 30, the two halves are forced together and each barb slips over an edge 35 in a receiving aperture. To release each pin 25 a thin utensil is inserted into the aperture from outside the housing half 5*a* or 5*b* and the barb forced past the edge 35** to release the interlock. However, to facilitate a user employing the subject device, usually, the housing stays in place about a plug P or receptacle R and is not routinely removed.

To position correctly a plug P or receptacle R within a housing, for forming an electrically functioning connection, a means, associated with the wall member of each housing half **5*a* or 5*b* for positioning or supporting the back end of the plug P or receptacle R, is required and included. As mentioned above, usually, one of two preferred positioning means is provided in the subject invention. With either of the two positioning means, the positioning means is located proximate the wall member second end 15. First, FIGS. 2–5 specifically focus on one of the positioning means. The first positioning means comprises a slotted positioning washer 40. The slot in the washer 40 fits around the cord C1 or C2 that extends from the connector P or R, respectively. Formed on the inner surface of the wall member, proximate the second narrow end 15 are a series of receiving grooves 45 within protruding ribs 50. A central aperture extends the length of interlocked housing 5*a*. Shown in FIGS. 2–5 is a plug P, however, a receptacle R is equally suitable. The slotted washer 40 abuts the plug P (or receptacle R) and fits within a selected receiving groove 45. The receiving groove 45 is selected to align the plug P (or receptacle R) for forming the electrically functioning coupling by preventing the coupling from disengaging within the jacket 1. Since plugs P and receptacles R come in various lengths, a variable position system is needed. Because the wall member tapers to a narrow end 15, a series of slotted washers 40 is required with each washer 40 sized (decreasing diameters towards the narrow end 15) to fit within the selected receiving groove 45**.

Figure 3:
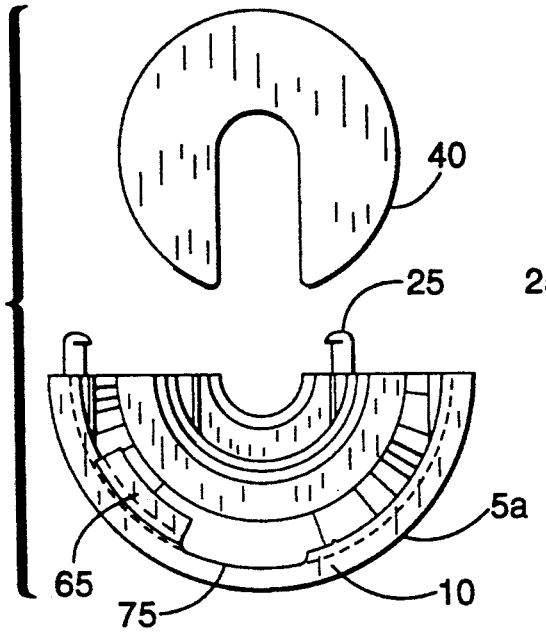
FIG. 3 is an end view of one half of a housing illustrating the alignment of a slotted positioning washer after insertion.
Figure 4:
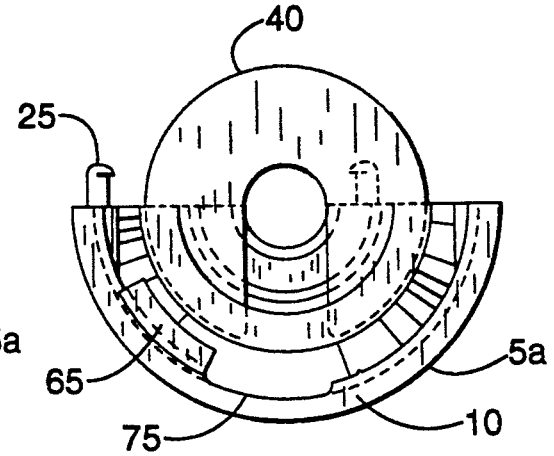
FIG. 4 is an end view of one half of a housing illustrating the alignment of a slotted positioning washer after insertion.
Figure 5:
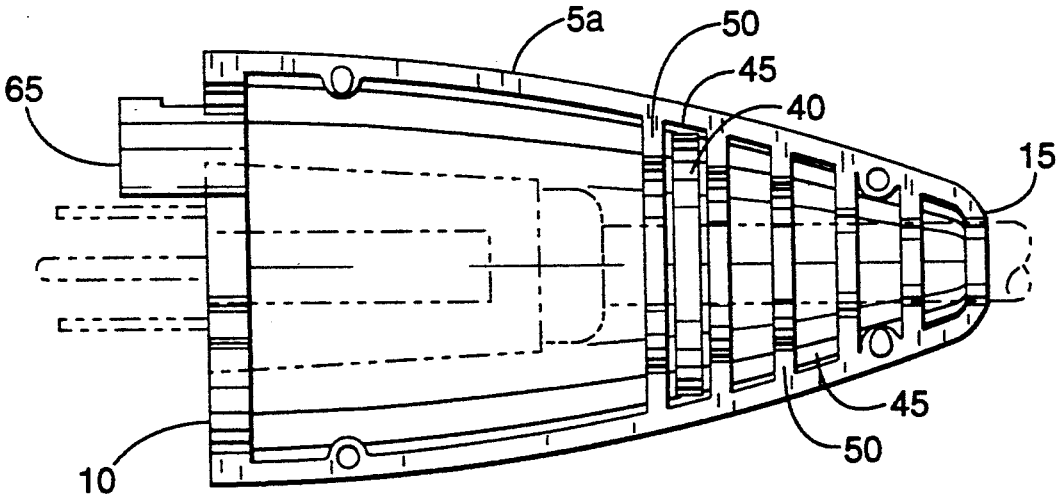
FIG. 5 is a top view of one half of a housing illustrating the use of a slotted positioning washer to hold a plug within the housing.
Figure 6:
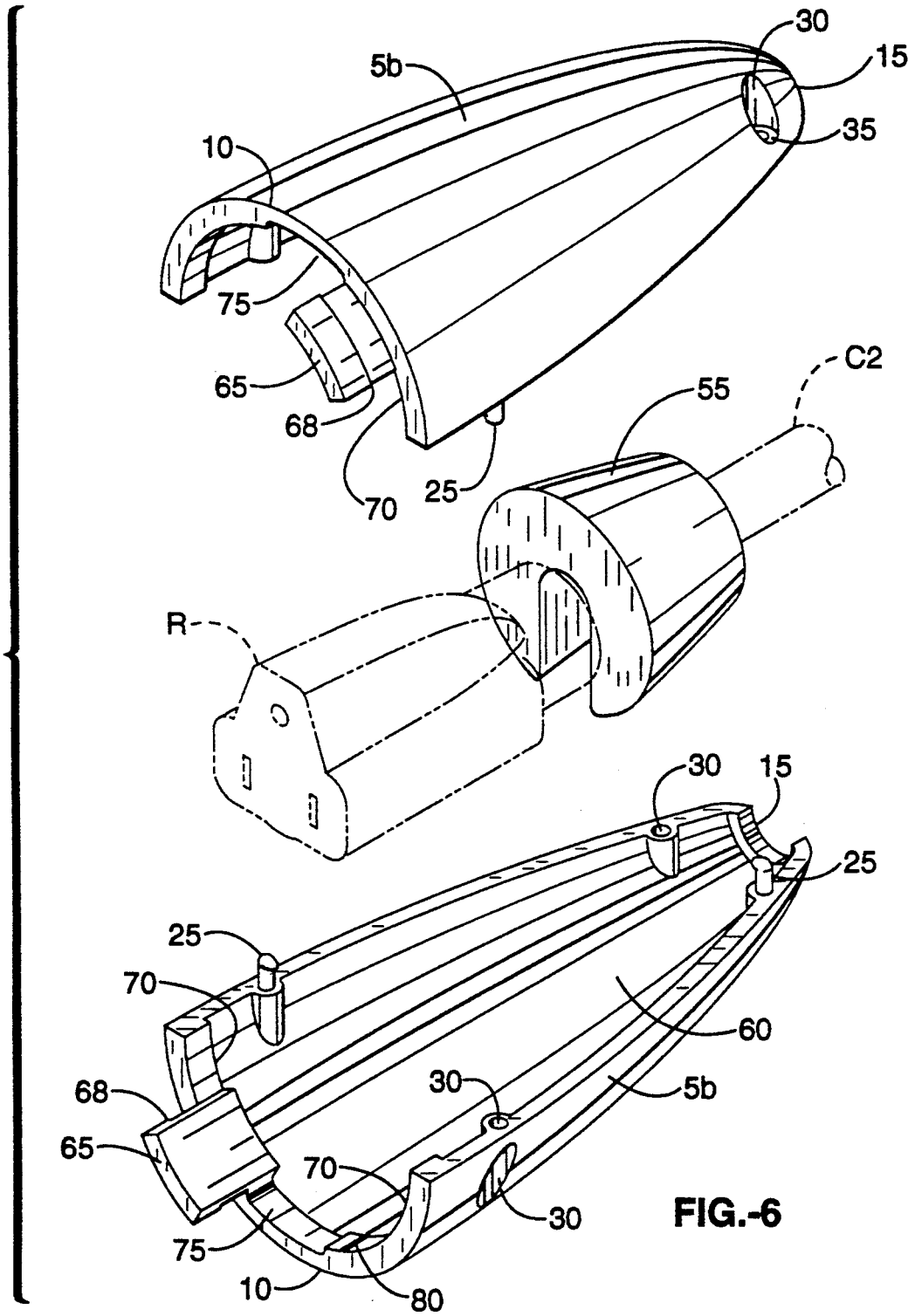
FIG. 6 is an exploded view of one half of the subject invention showing a second housing that will surround and hold a receptacle in which a slotted spacer is utilized to correctly position the receptacle within the second housing.

FIG. 3 illustrates the slotted washer 40 disposed above the housing half 5*a* that has the receiving grooves 45. FIG. 4 shows the location of the washer 40 when fitted within the housing half 5*a*. FIG. 5 depicts the washer 40 within the selected groove 45.

Second, FIGS. 6–9 specifically stress the other of the two preferred positioning means. The second preferred positioning means comprises a slotted spacer 55. The slot in the spacer 40 fits around the cord C1 or C2 that extends from the connector P or R, respectively. Unlike the grooved positioning means described above, the positioning means employing the slotted spacer 55 in housing half 5*b* has no grooves on the inner wall surface, but an open volume 60 for receiving the spacer 55. Shown in FIGS. 6–9 is a receptacle R, however, a plug P is equally suitable. The slotted spacer 55 abuts the receptacle R (or plug P) and fits within the volume 60. The length of the slotted spacer 55 is selected to align the receptacle R (or plug P) for forming the electrically functioning coupling by preventing the coupling from disengaging within the jacket 1. As indicated above, since plugs P and receptacles R come in various lengths, once again a variable position system is needed. A series of slotted spacers 55 is required with each spacer 55 sized in length and diameter (decreasing diameters towards the narrow end 15) to fit within the volume 60.

Figure 7:
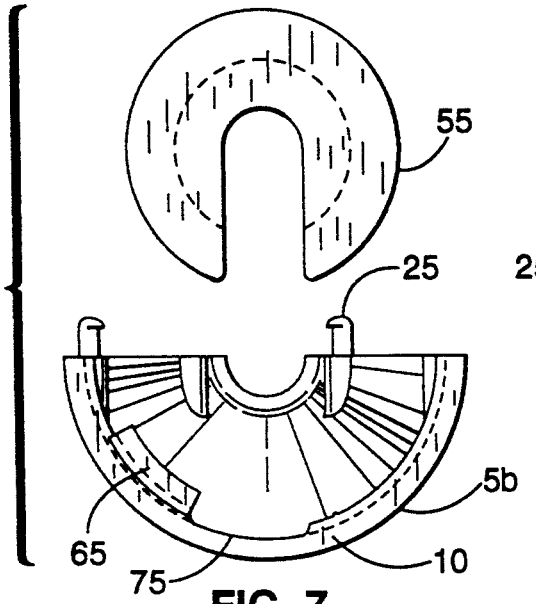
FIG. 7 is an end view of one half of a housing illustrating the alignment of a slotted positioning spacer before insertion.
Figure 8:
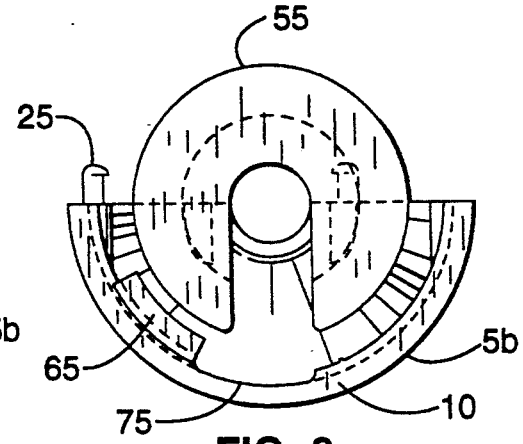
FIG. 8 is an end view of one half of a housing illustrating the alignment of a slotted positioning spacer after insertion.
Figure 9:
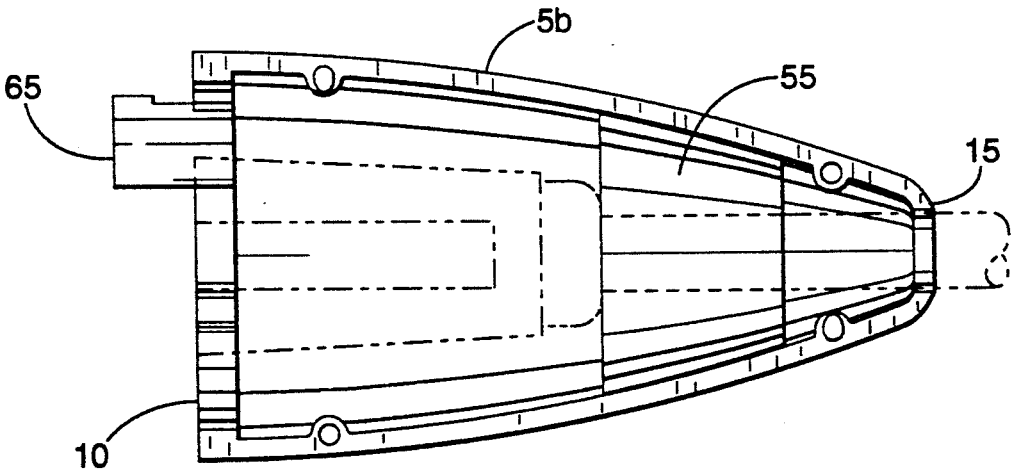
FIG. 9 is a top view of one half of a housing illustrating the use of a slotted positioning spacer to hold a receptacle within the housing.

FIG. 7 depicts the slotted spacer disposed above the housing half 5*b* that has the volume 60. FIG. 8 portrays the location of the spacer 55 when fitted within the housing half 5*b*. FIG. 9 represents the correctly selected spacer 55 fitted within the volume 60 and abutting the receptacle R (or plug P).

It should be remembered that regardless or the internal positioning means included in a housing half 5*a* or 5*b*, the other elements of the subject device remain the same.

Means are associated with each housing half wall member for mating one housing to another housing to form the subject jacket 1. Preferably, the housing to housing mating is easily reversible. The reversible nature of the mating permits a user to switch between one extension cord and many power tools utilizing the subject jacket 1. Further, one housing in the mated pair forming a jacket 1 may have the washer 40 to groove 45 positioning means and the other housing the spacer 55 to volume 60 positioning means. The mating means is located at the wall member wide first end 10. Comprising the reversible mating means is a male member or prong 65 projecting from each housing half wide end 10, the prong 65 terminates in a lip 68. Around the perimeter of the housing half's wide end 10 is a female member for engaging, usually reversibly, the male member prong 65. Specifically, the female member comprises an annular ledge 70 around the wide end 10 and an entrance channel 75 formed in the ledge 70 for receiving the prong 65 of another mating housing half 5*a* or 5*b*. To mate two housings 5*a* or 5*b* to one another to form the jacket 1, after the prong 65 of one housing half enters the channel 75 of another housing half (for each mating a total of four prongs 65 and four receiving channels 75 are involved), the first housing and the second housing are rotated about the longitudinal axis 20 in opposite directions. The lip 68 wedges beneath the annular ledge 70 to mate reversible the first to the second housing to form said jacket 1. To aid in securing the two mating housings 5*a* or 5*b* to one another, included is a locking bump 80 that forces the prong 65 to remain in the mated position. During mating the prong 65 deflects slightly to pass over the locking bump 80 and, if forced, deflects slightly during separation of a mated housings.

The invention has now been explained with reference to specific embodiments. Other embodiments will be suggested to those of ordinary skill in the appropriate art upon review of the present specification.

Although the foregoing invention has been described in some detail by way of illustration and example for purposes of clarity of understanding, it will be obvious that certain changes and modifications may be practiced within the scope of the appended claims.

What is claimed is:

1. An electrical connector jacket for preserving an electrically functioning coupling between a plug attached to a first cord and a receptacle attached to a second cord, comprising:

a) a first housing for surrounding and holding said plug, wherein said first housing comprises two like halves that interlock with one another to surround said plug and b) a second housing for surrounding and holding said receptacle, wherein said second housing comprises two additional said halves that interlock with one another to surround said receptacle and said first and said second housings mate with one another to form said jacket, wherein each said half comprises:

a curved, elongated wall member having first and second ends with a longitudinal axis extending between said first and said second ends;

means associated with said wall member for positioning either said plug and said first cord or said receptacle and said second cord within said first or said second housing, respectively;

means associated with said wall member for said interlocking with said other housing half;

means associated with said wall member for said mating between said first and said second housings.

2. An electrical connector jacket according to claim 1, wherein said interlocking is reversible.

3. An electrical connector jacket according to claim 1, wherein said mating is reversible.

4. An electrical connector jacket according to claim 1, wherein said positioning means is located proximate said wall member second end.

5. An electrical connector jacket according to claim 1, wherein said mating means is located at said wall member first end.

6. An electrical connector jacket for preserving an electrically functioning coupling between a plug attached to a first cord and a receptacle attached to a second cord, comprising:

a) a first housing for surrounding and holding said plug, wherein said first housing comprises two identical halves that reversibly interlock with one another to surround said plug and b) a second housing for surrounding and holding said receptacle, wherein said second housing comprises two additional said halves that reversibly interlock with one another to surround said receptacle and said first and said second housings reversibly mate with one another to form said jacket, wherein each said half comprises:

a curved, elongated wall member having an inner and an outer surface and first and second ends, wherein said wall tapers from a wide said first end to a narrow said second end with a longitudinal axis extending between said wide first and said narrow second ends;

means associated with said wall member for positioning either said plug and said first cord or said receptacle and said second cord within said first or said second housing, respectively, wherein said plug or said receptacle is proximate said wide first end and said first cord or said second cord passes through said narrow second end;

means associated with said wall member for said reversible interlocking with said other housing half;

means associated with said wall member for said reversible mating between said first and said second housings.

7. An electrical connector jacket according to claim 6, wherein said positioning means comprises:

a) a plurality of receiving grooves formed on said wall member inner surface and proximate said second narrow end and b) a slotted positioning washer sized to fit within said receiving grooves and around said first or said second cord, abutting said plug or said receptacle, within said first or said second housing, respectively, wherein said slotted positioning washer aligns said plug or said receptacle for forming said electrically functioning coupling by preventing said coupling from disengaging within said jacket.

8. An electrical connector jacket according to claim 6, wherein said positioning means comprises a slotted spacer selected to fit around said first or said second cord, abutting said plug or said receptacle, within said first or said second housing, respectively, wherein said slotted spacer aligns said plug or said receptacle for forming said electrically functioning coupling by preventing said coupling from disengaging within said jacket.

9. An electrical connector jacket according to claim 6, wherein said reversible mating means comprises:

a) a male member projecting from each said wide first end and b) a female member associated with said wide first end for reversibly engaging a corresponding said male member.

10. An electrical connector jacket according to claim 6, wherein said reversible mating means comprises:

a) a prong projecting from each said wide first end, wherein said prong terminates in a lip;

b) an annular ledge at said wide first end; and c) an entrance channel within said ledge for receiving said prong, wherein after said prong of one said housing half enters said channel of another said housing half and said first housing and said second housing are rotated about said longitudinal axis in opposite directions said lip wedges beneath said annular ledge to mate reversibly said first to said second housing to form said jacket.

11. An electrical connector jacket for preserving an electrically functioning coupling between a plug attached to a first cord and a receptacle attached to a second cord, comprising:

a) a first housing for surrounding and holding said plug, wherein said first housing comprises two like halves that interlock with one another to surround said plug and b) a second housing for surrounding and holding said receptacle, wherein said second housing comprises two said halves that interlock with one another to surround said receptacle and said first and said second housings mate with one another to form said jacket, wherein each said half comprises:

a curved, elongated wall member having first and second ends, wherein said wall tapers from a wide said first end to a narrow said second end with a longitudinal axis extending between said first and said second ends;

means associated with said wall member for positioning either said plug and said first cord or said receptacle and said second cord within said first or said second housing, respectively;

means associated with said wall member for said interlocking with said other housing half;

means associated with said wall member for said mating between said first and said second housings, wherein said mating means comprises:

a prong projecting from each said wide first end, wherein said prong terminates in a lip;

an annular ledge at said wide first end; and an entrance channel within said ledge for receiving said prong, wherein after said prong of one housing half enters said channel of another housing half and said first housing and said second housing are rotated about said longitudinal axis in opposite directions said lip wedges beneath said annular ledge to mate reversibly said first to said second housing to form said jacket.

12. An electrical connector jacket according to claim 11, wherein said positioning means comprises:

a) a plurality of receiving grooves formed on said wall member inner surface and proximate said second narrow end and b) a slotted positioning washer sized to fit within said receiving grooves and around said first or said second cord, abutting said plug or said receptacle, within said first or said second housing, respectively, wherein said slotted positioning washer aligns said plug or said receptacle for forming said electrically functioning coupling by preventing said coupling from disengaging within said jacket.

13. An electrical connector jacket according to claim 11, wherein said positioning means comprises a slotted spacer selected to fit around said first or said second cord, abutting said plug or said receptacle, within said first or said second housing, respectively, wherein said slotted spacer aligns said plug or said receptacle for forming said electrically functioning coupling by preventing said coupling from disengaging within said jacket.

* * * * *